US006782578B1

(12) United States Patent
Rief et al.

(10) Patent No.: US 6,782,578 B1
(45) Date of Patent: Aug. 31, 2004

(54) SWIMMING POOL PRESSURE CLEANER WITH INTERNAL STEERING MECHANISM

(75) Inventors: Dieter J. Rief, Santa Rosa, CA (US); Manuela Rief, Santa Rosa, CA (US)

(73) Assignee: Poolvergnuegen, Santa Rosa, CA (US)

( * ) Notice: Subject to any disclaimer, the term of this patent is extended or adjusted under 35 U.S.C. 154(b) by 0 days.

(21) Appl. No.: 10/296,779

(22) PCT Filed: May 26, 2000

(86) PCT No.: PCT/US00/14770

§ 371 (c)(1),
(2), (4) Date: Nov. 26, 2002

(87) PCT Pub. No.: WO01/92663

PCT Pub. Date: Dec. 6, 2001

(51) Int. Cl.[7] ..... E04H 4/16; E04H 3/20
(52) U.S. Cl. ..... 15/1.7
(58) Field of Search ..... 15/1.7

(56) References Cited

U.S. PATENT DOCUMENTS 3,972,339 A 8/1976 Henkin et al.
6,131,227 A 10/2000 Rief et al.
6,292,970 B1 9/2001 Rief et al.

FOREIGN PATENT DOCUMENTS

WO WO 01/92663 12/2001

*Primary Examiner*—Randall Chin
(74) *Attorney, Agent, or Firm*—Jansson, Shupe & Munger, Ltd.

(57) ABSTRACT

A swimming pool pressure cleaner (20) of the type motivated by water flow through it having: a set of two wheels (22*a, b*) rotatably mounted to the body (24); a turbine housing (38) having a water-flow chamber (40) with an inlet (70) and an outlet (74), the inlet held in proximity to the pool surface (54); a vaned rotor (48) rotatably mounted in the chamber; one or more one venturi jets (66*a, b*) secured to the body and oriented to direct water into the inlet to rotate the turbine and cause flow from the pool into the inlet; a drive member (76) secured to the rotor and a drive train extending to the wheels for synchronous rotation on the pool surface; a cam (100) rotatably secured to the body and driven by the rotor through reduction gearing (106); and a linkage (94) from the cam to one wheel (22*a*) to periodically interrupt the synchronous rotation of the wheels on the pool surface and change pool cleaner direction.

31 Claims, 8 Drawing Sheets

SWIMMING POOL PRESSURE CLEANER WITH INTERNAL STEERING MECHANISM

FIELD OF THE INVENTION

The present invention relates to swimming pool cleaners and, more particularly, to automatic swimming pool cleaners driven by the flow of water therethrough for purposes of cleaning. Still more particularly, this invention relates to swimming pool pressure cleaners (as opposed to suction-type cleaners) of the type powered by the flow of water pumped by remote pumps into and through the pool cleaners.

BACKGROUND OF THE INVENTION

Automatic swimming pool cleaners of the type that move about the underwater surfaces of a swimming pool are driven by many different kinds of systems. A variety of different pool cleaner drive devices in one way or another harness the flow of water, as it is drawn or pushed through the pool cleaner by the pumping action of a remote pump for debris collection purposes, to create forward pool cleaner movement. Some of the many kinds of water-driven automatic pool cleaners are those driven in various ways by turbines, which translate water movement into rotational motion. Wheel rotation by linkage to a turbine or other drive mechanism causes propulsion in such prior art devices. Various problems and shortcoming exist in such prior devices.

Among the problems and shortcomings not adequately addressed are failures of certain kinds of cleaners to provide complete cleaning coverage. Obtaining complete coverage is particularly difficult or problematic for swimming pools having certain kinds of surfaces, surface shapes or obstacles. Complete coverage and satisfactory cleaning are difficult to obtain when the pumping pressure generated by the remote pump is weak, such that the driving force of a pool cleaner is seriously diminished. Various automatic pool cleaners of the prior art have insufficient speed and strength of movement, and this creates and acerbates problems of weak cleaning ability.

Some problems, failures or difficulties occur when pool cleaners get hung up or caught at an area where its driving wheels are unable to contact the underwater pool surfaces, or are at least unable to engage such surfaces with sufficient traction to allow movement of the pool cleaner. For some cleaners of the prior art, steering (that is, the motions taken by pool cleaners in order to change directions) can be problematic, particularly on certain kinds of surfaces and when speed is low and the steering and propulsion forces that are generated are low.

Certain of these problems are particularly difficult with respect to so-called "pressure cleaners"—i.e., those pool cleaners the movement of which is motivated by the flow of water pumped to the pool cleaner from a remote pump, as opposed to the more common suction cleaners, through which water is sucked by a remote pump. One problem particularly seen with respect to pressure cleaners is difficulty in obtaining reliable steering for complete coverage of the underwater surfaces of a pool. Steering of certain pressure cleaners of the prior art is typically by external means.

A brief description of certain swimming pool pressure cleaners of the prior art will be helpful. Such pool cleaner includes the pool cleaner unit itself at the end of a water-supply hose and a separate box-like control unit along the hose and spaced from the pool cleaner unit itself by a distance on the order of ten feet or so. The pool cleaner unit itself is a wheeled device which includes a turbine for driving the wheels, but does not have any steering apparatus incorporated with it. The box-like control unit, which has a second turbine and a sequencing device, periodically shuts off the flow of water to the pool cleaner unit itself and at the same time opens up an orifice which shoots a jet of water from the control unit such that the control unit, acting through the hose, in effect drags the pool cleaner unit into a different orientation and/or position, after which the flow to the pool cleaner unit is reestablished and the jet of water from the control unit is stopped.

In such prior pressure cleaning apparatus, water flow to the pool cleaner unit itself, which has already been used to move a turbine in the control unit, is split into two streams—one for driving the turbine in the pool cleaner unit and one to establish a venturi action for drawing water and debris into a flow path leading to a filter bag or the like. Due to the prior usage and flow splitting, sometimes including an additional separate flow for the purpose of placing or keeping dirt near the pool cleaner in suspension, power for pool cleaner movement is lost and, perhaps more importantly, flow for creating the venturi is limited.

As a result, the venturi jet(s) used in such prior systems are made very small—sometimes as low as about 0.100–0.160 inch in diameter—allow development of high linear flow velocities of water from the venturi jet(s), despite the low flow volume. Low flow volumes and very localized venturi effects limit pool cleaning effectiveness in such prior pool cleaners. One specific result of the low flow volumes from the venturi jet(s) is that the opening for inflow of water and debris is more limited in size than is desirable. Thus, the inflow of debris and the size of the debris which can be collected are more limited than is desirable.

Other problems and shortcomings are associated with such apparatus. Control of the pool cleaner at best tends to be rather ineffective, resulting in ineffective coverage of the surfaces of a pool. Furthermore, because of division of water flow from the hose, the water available to operate the principal turbine of the apparatus is reduced, and this in turn reduces the strength of travel of the pool cleaner unit and detracts from its cleaning power.

While various advances have been made in the field of automatic swimming pool cleaners, including pressure cleaners, as of this writing there remains a need for an pressure cleaner for swimming pools which is internally self-steerable. More generally, there is a need for automatic pool cleaners with improved functionality to address the problems referred to above.

OBJECTS OF THE INVENTION

It is an object of this invention to provide an improved swimming pool cleaner pressure cleaner of the automatic water-driven type which overcomes some of the problems and shortcomings of the prior art.

Another object of this invention is to provide an improved water-driven swimming pool pressure cleaner having an internal steering mechanism.

Another object of the invention is to provide an improved water-driven swimming pool pressure cleaner giving excellent coverage and cleaning of underwater pool surfaces, including hard-to-reach areas.

Another object is to provide an improved water-driven swimming pool pressure cleaner with highly reliable self-steering.

Another object of the invention is to provide an improved water-driven swimming pool pressure cleaner which has excellent traction in a variety of situations.

Another object of this invention is to provide an improved water-driven swimming pool pressure cleaner able to utilize a greater portion of flow from the remote pump, and a greater portion of the power of the flow from the remote pump, to create venturi action for picking up debris.

Another object of this invention is to provide an improved water-driven swimming pool pressure cleaner with larger inflow openings for water and debris and an increased venturi effect in drawing of unwanted debris into a collector.

Another object of this invention is to provide an improved water-driven swimming pool pressure cleaner which can operate effectively at lower pressures than many pressure cleaners of the prior art.

Still another object of the invention is to provide an improved water-driven swimming pool pressure cleaner which has excellent ability to traverse pool surfaces of different types and hard-to-reach pool areas.

Another object of the invention is to provide an improved water-driven swimming pool pressure cleaner which generates good driving power even when used with pool pumping systems generating low pumping pressures.

Another object of the invention is to provide an improved water-driven swimming pool pressure cleaner which resists any tendency to become hung up and is capable of extracting itself from situations in which there is a lack of traction.

Still another object is to provide an improved water-driven swimming pool pressure cleaner with excellent speed and steering (direction-changing) capabilities.

These and other objects of the invention will be apparent from the following descriptions and from the drawings.

SUMMARY OF THE INVENTION

This invention is an improved swimming pool pressure cleaner of the type motivated by water flow through it to move along a pool surface to be cleaned. The invention, including in its preferred embodiments, overcomes various problems and shortcomings of the prior art, including those referred to above. The invention is a pressure cleaner for swimming pools which incorporates within itself apparatus which provides self-steering.

The swimming pool pressure cleaner of this invention provides many important advantages, including the following: compactness in a pressure cleaner with steering by virtue of the inclusion of steering apparatus in a single structure; excellent coverage of underwater surfaces, highly-reliable self-steering; improved take-up of debris, a larger inflow opening for debris; better utilization of water flow, for purposes of propulsion, steering and take-up of debris; effective pool cleaner operation at low pressure; excellent traction; ability to avoid and/or escape situations involving hang-up of the pool cleaner; and excellent speed and power.

The swimming pool pressure cleaner is a pressure cleaner of the type including a body, wheels rotatably mounted to the body, a turbine housing having a water-flow chamber formed by a chamber wall and having an inlet and an outlet, a turbine rotor rotatably mounted in the chamber and having vanes, a drive member secured to the rotor and a drive train from the drive member to drive the wheels on underwater pool surfaces, a venturi jet and a water conduit to feed water to the venturi jet from a hose.

In the inventive pool cleaner, the turbine inlet is supported in close proximity to the pool surface and the venturi jet is located at the turbine inlet, oriented to direct water into the turbine inlet—to both rotate the turbine and cause water and debris to flow from the pool past the venturi jet and into the inlet, by means of venturi action. The pool cleaner also includes a steering mechanism secured to the body and having a movable part which periodically interrupts the synchronous rotation of the wheels on the pool surface, thereby causing changes in the direction of pool cleaner travel.

The steering mechanism in the pool cleaner of this invention is sometimes referred to as "internal." The pool cleaners of this invention are compared to pressure cleaners having an additional apparatus which may be said to provide some "steering" for a pool cleaner. But such additional apparatus is separate from the pool cleaner and linked to it only by a length of flexible hose by which the additional apparatus pulls the pool cleaner unit in various directions. With this in mind, the term "internal" as used herein means "affixed thereto as a part thereof " Thus, the term "internal" does not carry with it the idea that the steering mechanism is enclosed to any extent.

In highly preferred embodiments, the steering mechanism includes: a cam having portions of greater and lesser radii which is rotatably secured to the body and driven by the rotor through reduction gearing; and linkage from the cam to a wheel to periodically interrupt synchronous rotation of the wheels on the pool surface.

In more detail, the device of this invention includes: a body having front, rear and opposite sides; a set of two wheels rotatably mounted to the body, one on each side; a turbine housing secured to the body and having a water-flow chamber formed by a chamber wall, the chamber having an inlet and an outlet, the inlet supported in close proximity to the pool surface; a turbine rotor rotatably mounted in the chamber, the rotor having vanes, one or more venturi jets secured to the body and oriented to direct water into the inlet to rotate the turbine and cause, by virtue of the venturi action, a flow of water and debris from the pool into the inlet; one or more water conduits to transmit water from a hose to the one or more venturi jets; a drive member secured to the rotor and rotatable with the rotor; a drive train from the drive member to the wheels for synchronous rotation of the wheels on the underwater pool surfaces; a cam having portions of greater and lesser radii, the cam being rotatably secured to the body and driven by the rotor through reduction gearing; and a linkage from the cam to one of the wheels to periodically interrupt the synchronous rotation of the wheels on the pool surface and thereby change the direction of pool cleaner movement.

The water conduit transmitting water to the venturi jets is fed by a flexible hose which is attached in fluid-flow relation to an upstream end of the conduit hose. Water is supplied under pressure from a remote pump through the hose, through a rotatable cylindrical sleeve mount on the housing, in well-known fashion.

In preferred embodiments, there are a plurality of spaced venturi jets. Multiple jets improve the venturi action which draws water and debris from near the underwater surfaces of the pool into the pool cleaner—and ultimately into a filter attached to the pool cleaner. The presence of two or three venturi jets is preferred, and the spacing not only provides more venturi action but serves to provide space to facilitate flow of debris into the inlet. At least one of the venturi jets is preferably oriented toward the outlet to provide an accelerated flow of water directly toward the outlet. Preferred embodiments of this invention include a debris-capturing bag secured to the outlet.

The improved pressure cleaner of this invention provides excellent power and drive particularly when the turbine is in the highly preferred forms which are the subject of U.S. Pat. No. 6,292,970, entitled "Turbine-Driven Automatic Swimming Pool Cleaners," to Dieter J. Rief and Manuela Rief, the inventors herein, and Rosemarie Rief.

In such preferred form, the turbine vanes have proximal ends connected to the rotor and distal ends movable with respect to the rotor between extended positions adjacent to the wall of the turbine chamber and retracted positions which are spaced from the wall and closer to the rotor. Preferably, the turbine vanes are pivotably mounted with respect to the rotor, and most preferably the turbine vanes are curved and have distal edges which contact the chamber wall in their extended positions, at least in certain positions about the rotor. A preferred form of rotational mounting of the vanes is as follows: The rotor has an exterior surface beneath which, for each vane, there is a corresponding cavity which pivotably holds the proximal end of the vane. Enlargements at the proximal ends of the vanes are sized for free insertion into, and pivotable engagement in, the cavities within the rotor.

Each wheel, of course, has an inward side and an outward side depending upon how it is mounted on the pool cleaner. In preferred embodiments of this invention, the first wheel of the set has radially-spaced primary and secondary wheelgears on its inward side, such wheelgears facing one another, and the second wheel of the set has another primary wheelgear on its inward side, the primary wheelgears on the two wheels being similar to one another. Preferably, the drive train terminates at the first and second wheels in first and second drive pinions, respectively, each engaging the primary wheelgear of the respective wheel; this serves to drive the wheels in the forward direction synchronously, in contact with the underwater pool cleaner surface.

In such embodiments, it is preferred that the wheelgears of the first wheel be concentric, and integrally formed with the first wheel itself. The wheelgear of the second wheel is also preferably integrally formed with the second wheel. Most preferably, the first and second wheels are identical, and therefore interchangeable.

As used herein, the term "wheelgear" refers to any gear which is affixed on, or formed as part of, a swimming pool cleaner wheel which contacts the surface of the pool to propel the pool cleaner. Among the wheelgears referred to herein are the aforementioned primary and secondary gears and, as will be seen below, gears referred to as "final" wheelgears.

In preferred embodiments, the drive member is a drive gear and the drive train includes first and second drive shafts which are journaled with respect to the body and which have proximal and distal ends. In such embodiments, the first and second drive pinions, mentioned above, are driven by the first and second drive shafts, respectively, and the drive train is a gear train from the drive gear to the first and second drive shafts. Preferably, the first and second drive shafts form the first and second drive pinions, respectively, at their distal ends.

The drive train preferably includes a coupler with opposite ends receiving the proximal ends of the first and second drive shafts. The proximal end of the first drive shaft is a ball joint which allows the first drive shaft to be pivoted off-axis. This allows the distal end of the first drive shaft to be moved fore and aft between a driving position in which the first drive pinion engages the primary wheelgear of the first wheel and a steering position in which it engages the secondary wheelgear of the first wheel. This movement, from engagement with a wheelgear in the form of a ring gear (with inwardly-facing teeth) to engagement with a wheelgear having outwardly-facing teeth, causes the first wheel to change its direction of rotation—i.e., to rotate in a direction opposite that of the second wheel. This interrupts the synchronous rotation of the wheels on the pool surface, and causes turning of the pool cleaner.

The rotatable cam (a timing cam) mentioned above serves to provide steering of the pool cleaner; in one way or another it causes interruption of synchronous rotation of the first and second wheels on the pool surfaces. In certain preferred embodiments, the linkage from the cam to the first wheel includes a shift bracket assembly which is slidably held by the body in a position such that the first drive shaft is journaled in it, thereby to allow movement of the distal end of the first drive shaft between driving and steering positions, by movement of the shift bracket assembly.

The cam wheel engages the shift bracket and a spring biases the shift bracket toward the cam wheel, such that the cam wheel, acting through the shift bracket assembly, provides the fore-and-aft movement by alternately (a) holding the distal end of the first drive shaft in the driving position and (b) allowing the distal end of the first drive shaft to move to the steering position by virtue of the action of the spring.

The rotatable cam can interrupt synchronous rotation of the first and second wheels on the pool surfaces in other ways. One example of other forms of interruption involves a temporary lifting of one wheel from the surface of the pool when a cam portion of larger radius (larger than most of such cam) engages the pool surface and props one side of the pool cleaner away from the pool surface. In such example, even though the first and second wheels may continue to turn synchronously, they will not be turning synchronously on the pool surface; synchronous rotation on the pool surface is restored when the cam is no longer lifting one side of the pool cleaner.

In highly preferred embodiments, the wheels have treads with a multiplicity of outwardly extending radial fingers. It is most preferred that a small subset of the radial fingers (extending along a very small sector of the wheel) project radially farther than the other fingers. With this embodiment, if the pool cleaner for any reason is hung up on some obstruction or pool surface feature, the longer treads, when they come around, tend to provide traction for dislodgement purposes.

Certain highly preferred embodiments include a second set of wheels, once again including one wheel on each side of the pool cleaner. The wheels of the second set are preferably aft of the wheels of the first-mentioned set. Each of the wheels of the second set has what is being called a "final" wheelgear on its outward side. In such embodiments, there is an extended drive train for each of the wheels of the second set, and each such extended drive train includes a transfer shaft journaled with respect to the body, a first transfer pinion engaged with one of the primary wheelgears, and a second transfer pinion engaged with one of the final wheelgears. These extended drive trains serve to impart rotation to the wheels of the second set, having transferred rotational movement from the wheels of the first wheel set. Preferably, each transfer shaft itself forms the first and second transfer pinions at the opposite ends thereof.

In pressure cleaners with more than two wheels, it is preferred that all wheels, including those having "final" wheelgears on them, have wheelgears integrally formed with the wheel. Most preferably, all four wheels (or whatever number there are greater than two) are identical so that they can be completely interchangeable.

The preferred four-wheel-drive pressure cleaner for swimming pools is among the subjects of PCT Patent Application No. PCT/US00/14771, entitled "Four-Wheel-Drive Automatic Swimming Pool Cleaner," for an invention of Dieter J. Rief and Manuela Rief, the inventors herein.

In certain preferred embodiments, the aforementioned water inlet faces the surface of the pool and the device includes a skirt secured with respect to the body and extending toward the pool surface such that the skirt and the body, together with the pool surface, form a plenum from which water and debris are drawn into the inlet. The skirt is formed of at least one flap member which has upper and lower articulating portions, the upper articulating portion having a proximal edge hinged to the body and a lower edge hinged to the lower articulating portion. Most preferably, the skirt is segmented in that it is formed of a plurality of the articulated flap members in side-by-side arrangement, each having upper and lower articulating portions.

Such skirt, which is the subject of commonly-owned copending U.S. Pat. No. 6,131,227, entitled "Suction-Regulating Skirt for Automated Swimming Pool Cleaner Heads," to Dieter J. Rief, an inventor herein, and Hans Raines Schlitzer, facilitates relative enclosure of the plenum despite encountered irregularities in the pool surface immediately under the pool cleaner. As water is drawn into the turbine chamber through the inlet, the skirt minimizes the openness between the pool cleaner body and the underwater surface of the pool, and this causes a speed-up in the linear flow of water immediately along the underwater surface of the pool, at positions under the pool cleaner. Such speed-up of linear flow improves the ability of the pool cleaner to ingest debris along with water, so that the debris tends to move easily into the turbine chamber, and from there through the outlet and into a bag or other collector.

DETAILED DESCRIPTION OF PREFERRED EMBODIMENTS

FIGS. 1–9 illustrate a preferred swimming pool pressure cleaner cleaner 20 in accordance with this invention. Pool cleaner 20 has four identical drive wheels marked by numeral 22, including left front drive wheel 22*a*, right front drive wheel 22*b*, and left and right rear drive wheels 22*c* and 22*d*. All four drive wheels are driven to provide forward movement of pool cleaner 20. Rear drive wheels 22*c* and 22*d* are driven by separate linkages from front wheels 22*a* and 22*b*, respectively.

Left front drive wheel 22*a*, which is normally driven in a forward direction, is periodically temporarily driven in a reverse direction. When this occurs, left rear drive wheel 22*c* is also driven in a reverse direction by virtue of the linkage between drive wheels 22*a* and 22*c*. During such brief intermittent periods of reverse rotation, the direction of travel of pool cleaner 20 changes. This steering function, together with the power provided by four-wheel drive of this invention, provides excellent cleaning coverage of underwater pool surfaces 54.

Figure 6:
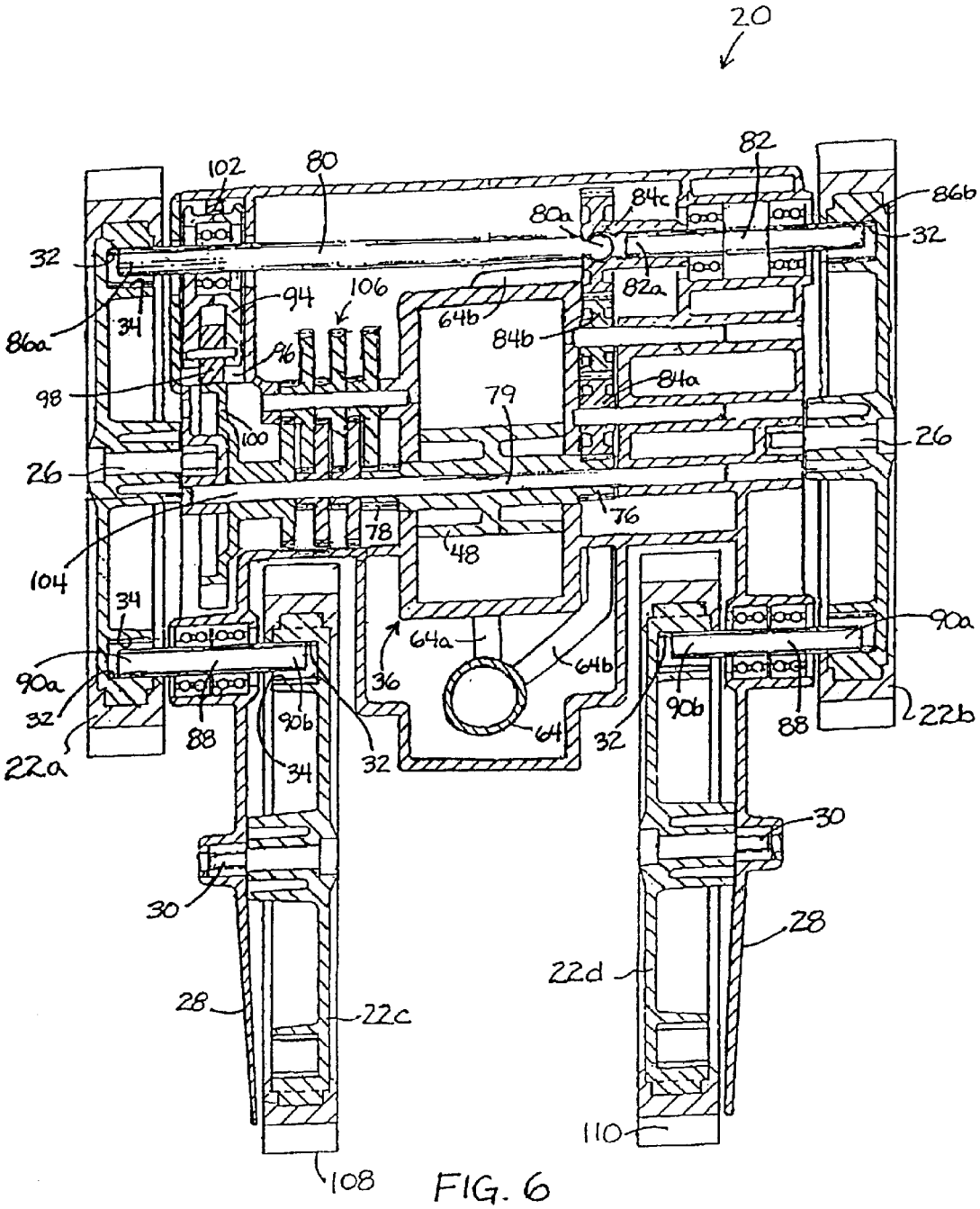
FIG. 6 is a detailed top sectional of the device of FIG. 1.

Pool cleaner 20 includes a body 24 preferably formed of two or more plastic pieces designed to accommodate the parts and features of the invention. Front drive wheels 22*a* and 22*b* are rotatably mounted to body 24 on wheel shafts 26, as shown in FIG. 6. Attached to body 24 are rear wheel supports 28, and rear wheels 22*c* and 22*d* are rotatably mounted thereon by wheel shafts 30. Front wheels 22*a* and 22*b* have gearing (hereafter described) on their inward surfaces, i.e., the surfaces facing each other. Rear wheels 22*c* and 22*d* have the same gearing on their outward surfaces. Drive wheels 22*a–d* are identical to each other, and thus are interchangeable.

The gearing on wheels 22*a–d* includes concentric radially-spaced primary and secondary wheelgears 32 and 34. Primary and secondary wheelgears 32 and 34 are radially spaced from one another by a distance in excess of the diameter of a pinion gear (hereafter described) which alternately engages such gears on drive wheel 22*a*. While all wheels are interchangeable, only drive wheel 22*a* uses both wheelgears; on drive wheels 22*b–d*, only wheelgear 32 is used.

Pool cleaner 20 has a turbine which uses pressurized flow of water from a hose to create rotary motion for transfer to the wheels by a drive train. More specifically, as shown in schematic FIG. 7, pool cleaner 20 includes a turbine 36, part of which, notably turbine housing 38, is secured to body 24. (As used with respect to turbine housing 38 and body 24, the term "secured to" includes having been formed together.)

Turbine housing 38 has a chamber 40 in it which is formed by a chamber wall 42. Chamber 40 includes an inlet port 70 and an outlet port 72. Turbine 36 also includes a rotor 48, which is rotatably mounted within chamber 40, and a number of turbine vanes 50, each of which has proximal and distal edges 50*a* and 50*b*. Proximal edge 50*a* of each vane 50 is generally cylindrical in shape and is loosely received within a generally cylindrical void in rotor 48, formed just below the outer surface of the rotor. Thus, vanes 50, which are of a curved configuration, freely move between fully extended positions in which they contact chamber wall 42 and retracted positions in which their distal edges 50*b* are closer to rotor 48 and spaced from chamber wall 42. This provides free adjustability of vanes 50 to facilitate passage of large pieces of debris to pass through chamber 40 without interfering with operation of the turbine. Chamber 40 is of substantial size to further facilitate flow of debris.

Figure 1:
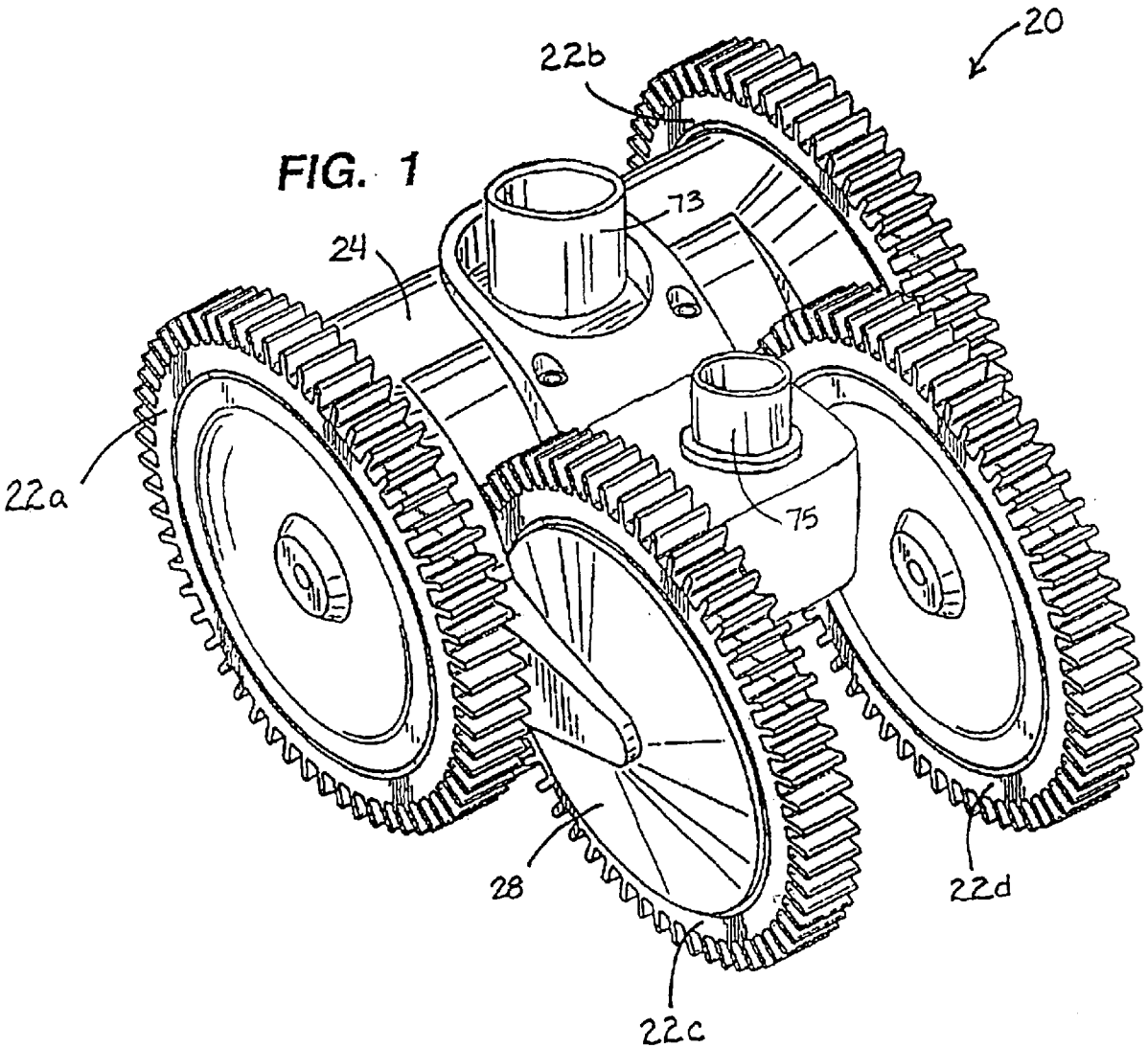
FIG. 1 is a perspective view of a preferred automatic pool cleaner in accordance with this invention, taken generally from the rear. The device is a suction cleaner.
Figure 2:
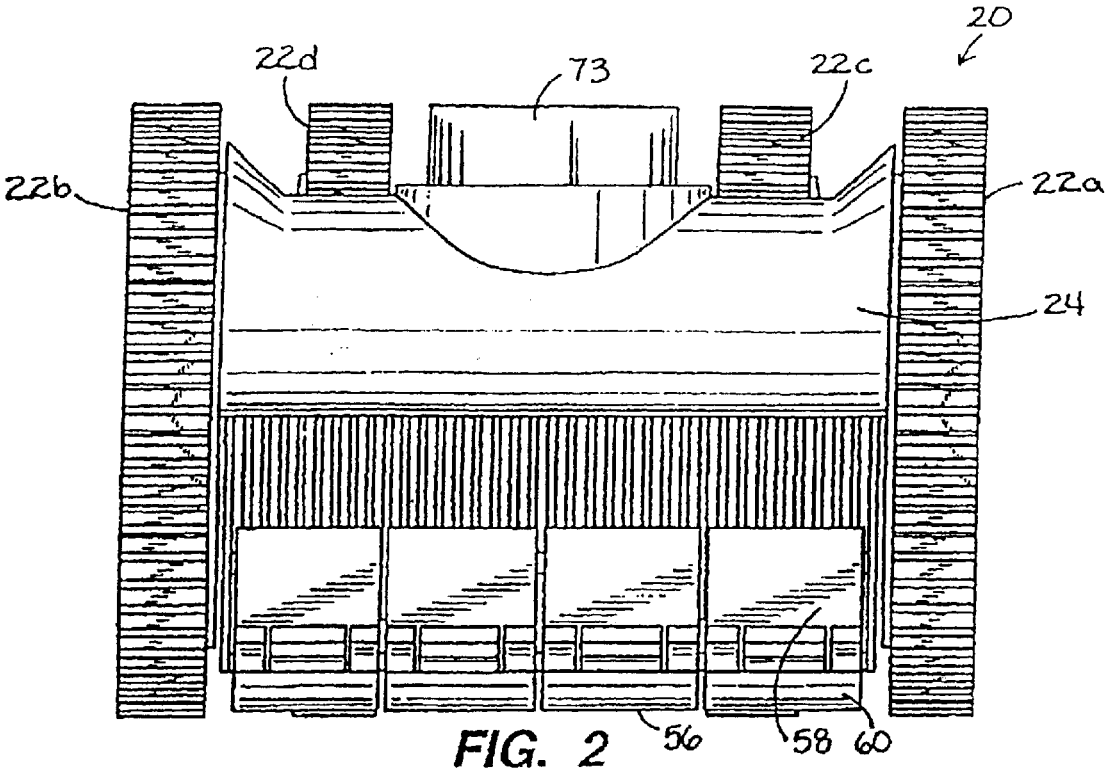
FIG. 2 is a front elevation of the device of FIG. 1.
Figure 4:
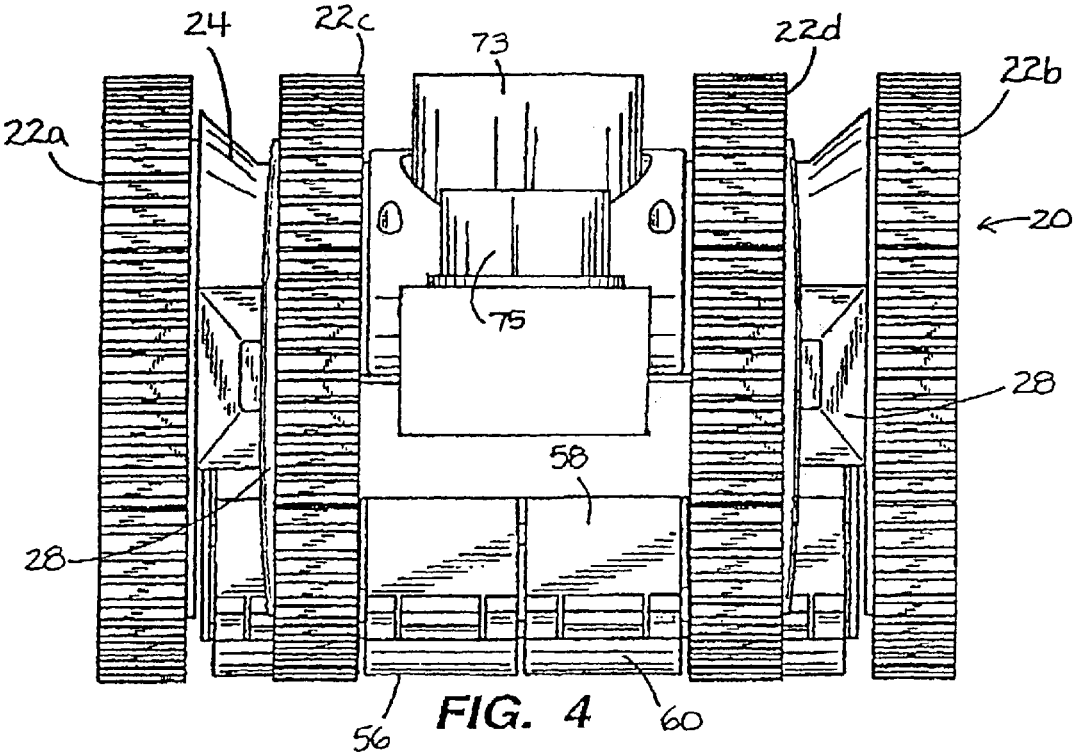
FIG. 4 is a rear elevation of the device of FIG. 1.
Figure 3:
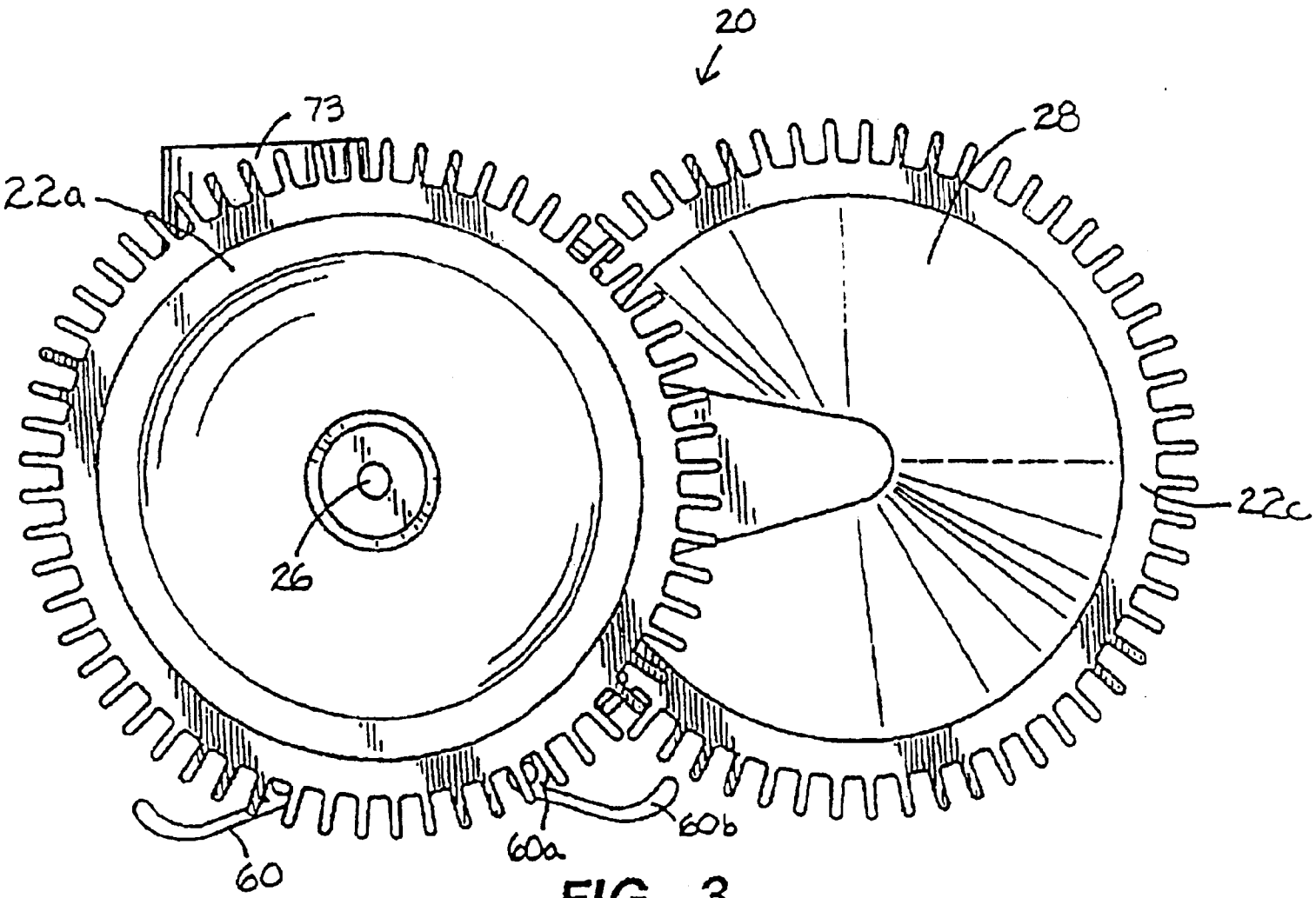
FIG. 3 is a left side elevation of the device of FIG. 1.
Figure 5:
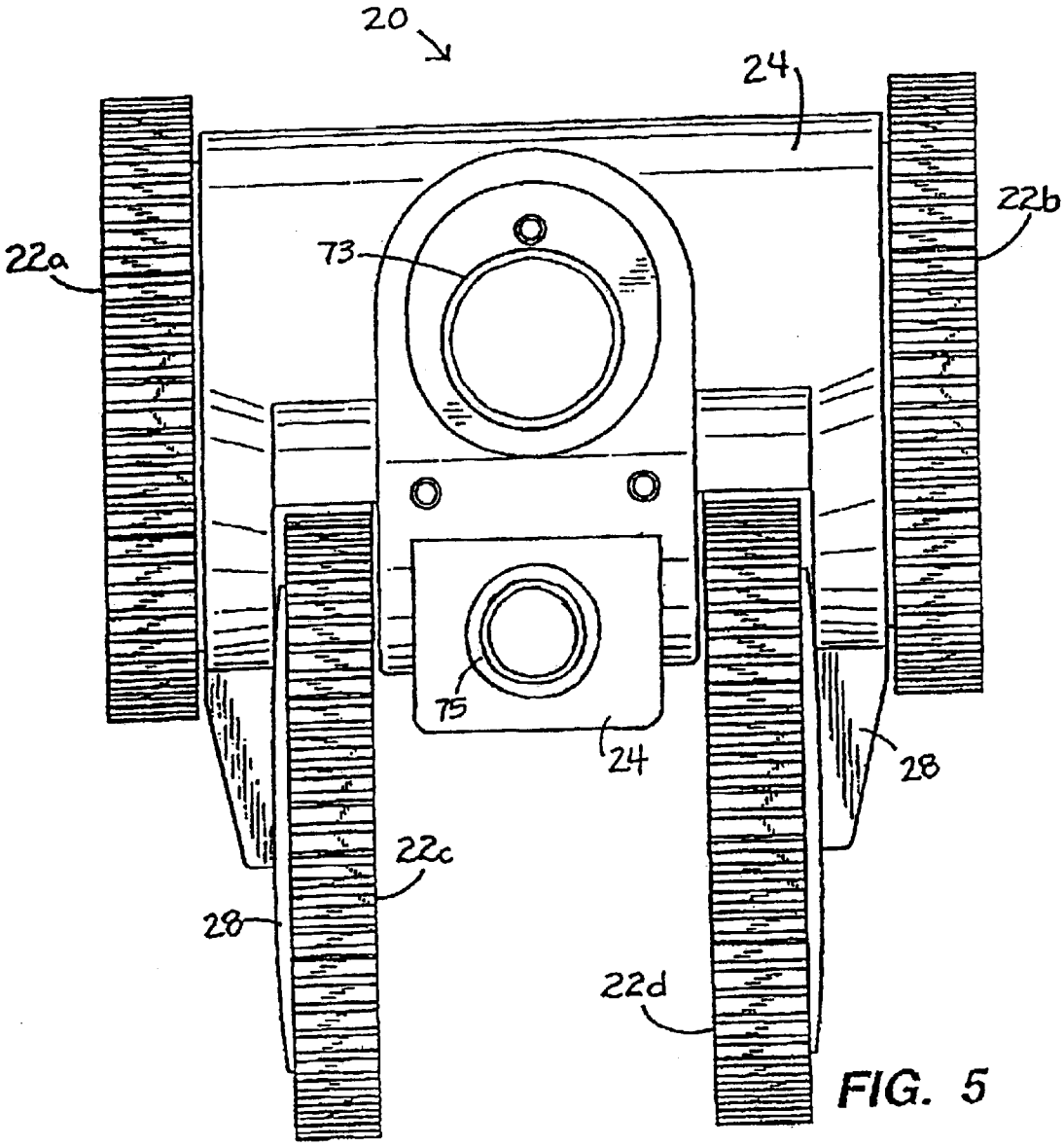
FIG. 5 is a top plan view of the device of FIG. 1.
Figure 7:
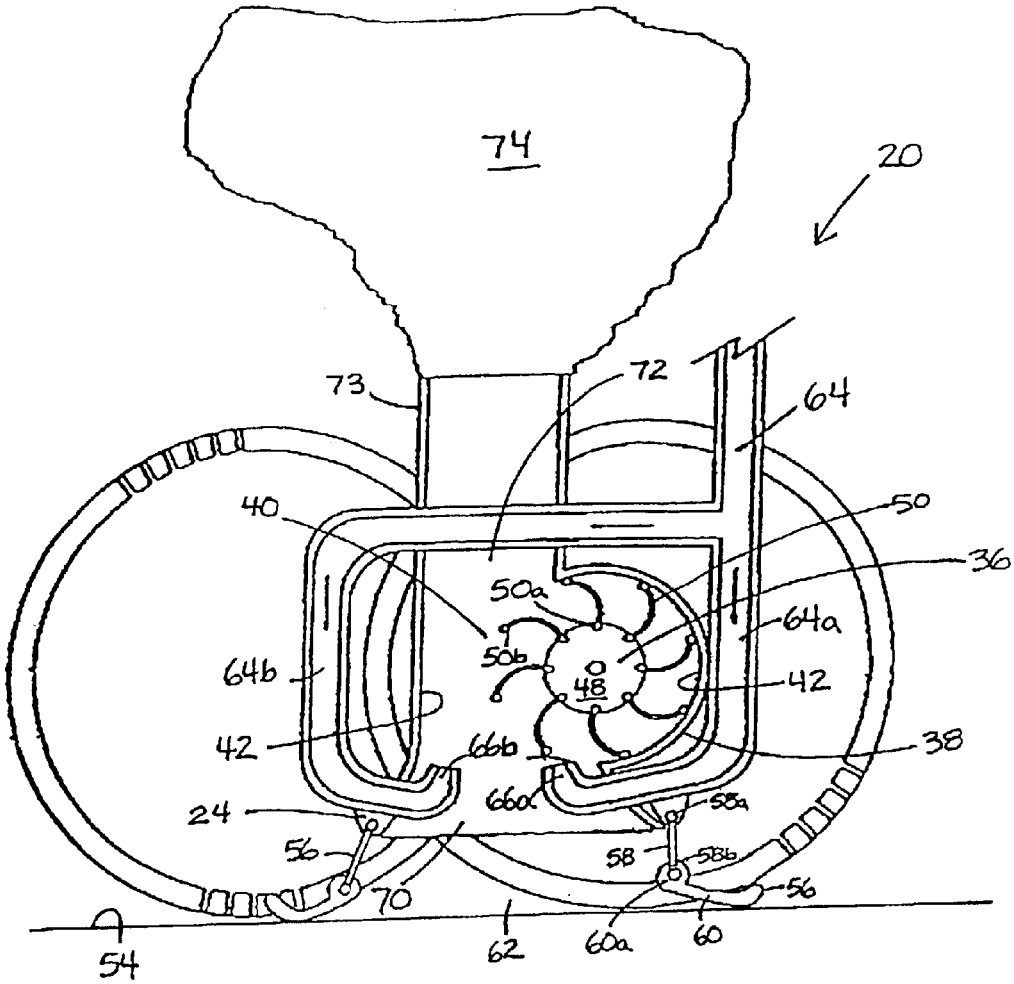
FIG. 7 is a schematic sectional side elevation illustrating aspects of the turbine portions of another embodiment of the invention, a swimming pool pressure cleaner.

Swimming pool pressure cleaner 20, as illustrated in FIG. 7, operates by receiving a flow of water through a flexible pool cleaner hose (not shown), which is attached to a swiveling hose coupling 75, shown in FIGS. 1, 4 and 5 (and not shown in FIG. 7) in well-known manner. The water from the hose flows through conduits 64 and conduit branches 64*a* and 64*b*, and ultimately through venturi jets 66*a* and 66*b* into turbine 68. Conduit 64 and conduit branches 64*a* and 64*b*, which are illustrated schematically in FIG. 7, extend within body 24 around turbine housing 38 by means of channels (not shown) formed in the housing or flexible hose (not shown). It should be remembered that FIG. 7 is schematic; it omits a number of parts and does not purport to show the location or structure providing conduits for flow of water from the hose to the venturi jets.

As shown in FIG. 7, turbine 68 has a large inlet 70 facing the pool surface 54; inlet 70 is larger than openings in certain prior pressure cleaners. Venturi jets 66*a* and 66*b* are at or near inlet 70 and are oriented to direct water upwardly into inlet 70 and toward outlet 72. Venturi jets 66*a* and 66*b*, particularly 66*a*, are located to cause rotation of rotor 48 of turbine 68 to provide driving and steering power for pressure cleaner 20. A venturi action caused by venturi jets 66*a* and 66*b* draws water and debris from beneath pool cleaner 20 through inlet 70, turbine 36 and outlet port 72 into a collection bag 74 connected to neck 73. Bag 74 acts as a filter, in known manner.

The venturi action is caused by the accelerated flow of water created by jets 66*a* and 66*b*. The accelerated flow of water creates a pressure differential which causes an upward suction of water and debris from adjacent to pool surface 54 into inlet 70. Thus, the venturi jets serve two purposes—driving the turbine and creating an upward flow from beneath the pool cleaner for cleaning purposes. The size and orientation of venturi jets 66*a* and 66*b* not only cause these actions, but serve to facilitate an essentially quick straight-line movement of debris into collection bag 74.

Turbine 36 serves two functions, providing power to drive wheels 22*a–d* through linkages (hereafter described) and providing power for operation of a steering device (hereafter described), both of which occur as water and debris are drawn through it by the above-described venturi action. The water pressure for pressure cleaner 20 is supplied by a remote pump, in known fashion.

Beneath pool cleaner 20, water inlet 70 faces underwater pool surface 54. Pool cleaner 20 includes a segmented skirt which has forward and rearward portions, each of which includes a number of flap members 56 arranged in side by side relationship. Together, flap members 56, body 24 and pool surface 54 form a plenum 62. Each flap member 56 includes an upper articulating portion 58 and a lower articulating portion 60. Upper portion 58 has a proximal end 58*a* which is hinged to body 24 and a distal end 58*b* which is hinged to a proximal end 60*a* of upper portion 60. By virtue of this design, flap members 56 self-adjust to the contours of pool surface 54. Flap members 56 serve to keep plenum 62 substantially closed, which provides flow characteristics favorable for collection of debris from beneath pool cleaner 20 by the venturi action.

The following is a description of the manner in which the rotation of rotor 48 is transmitted to drive wheels 22*a–d*. FIG. 6 is particularly helpful in illustrating the drive train and its three different portions. The three different portions include: (1) a first portion which extends from a first drive gear 76, affixed to rotor 48, to left and right front wheels 22*a* and 22*b*; (2) a second portion which extends from front wheel 22*a* to rear wheel 22*c*; and (3) a third portion which extends from front wheel 22*b* to rear wheel 22*d*. (The second and third portions of the drive train are identical to each other.) All four wheels are driven by first drive gear 76; a second drive gear 78, which is affixed to the opposite side of rotor 48, is used to control the steering of pool cleaner 20. (First and second drive gears 76 and 78 are integrally formed with rotor 48 and are affixed to a rotor shaft 79 which is rotatably mounted with respect to body 24.)

The first drive train portion includes left and right drive shafts 80 and 82, sometimes referred to as "first" and "second" drive shafts. They are in end-to-end alignment. The first drive train portion also includes a gear train having gears 84*a*, 84*b* and 84*c*. Gear 84*c* also serves as a coupler receiving the proximal ends 80*a* and 82*a* of drive shafts 80 and 82. (Proximal end 80*a* of drive shaft 80 forms a ball-joint coupling with coupling gear 84*c*, for steering-related purpose described below.) Drive shafts 80 and 82 terminate at their distal ends in pinion gears 86*a* and 86*b*, which are integrally formed with the shafts. Pinion gears 86*a* and 86*b* engage primary wheelgears 32 of drive train wheels 22*a* and 22*b*, respectively. Thus, the rotation of rotor 48 causes synchronous rotation of front drive wheels 22*a* and 22*b*, each in the same direction.

The rotation of front drive wheels 22*a* and 22*b* causes rotation of rear drive wheels 22*c* and 22*d*, by means of the second and third drive-train portions, which are now described. Each of these identical drive-train portions ends up engaging primary (or final) wheelgear 32 of one of rear drive wheels 22*c* and 22*d*. Adjacent to each rear wheel is a transfer shaft 88 journaled in body 24 by means of appropriate bearings. The opposite ends of each transfer shaft 88 include pinion gears 90*a* and 90*b*, which are formed as part of transfer shaft 88. Each pinion gear 90*a* engages primary wheelgear 32 of one of front drive wheels 22*a* or 22*b*, at a position spaced about 180° from the point of engagement of pinion gear 86*a* or 86*b* therewith. Each pinion gear 90*b* engages primary (or final) wheelgear 32 of one of rear drive wheels 22*c* and 22*d*.

The operation of the steering mechanism will now be described. Left drive shaft 80, which is generally in exact axial alignment with right drive shaft 82, can be moved off-axis by virtue of the ball-joint at its proximal end 80*a*. More specifically, pinion gear 86*a*, which is formed at the distal end of left drive shaft 80, is movable in fore-and-aft directions depending upon forces applied to drive shaft 80, as hereafter described. FIG. 7 shows an oblong opening 92 in a portion of body 24 which accommodates such movement of left drive shaft 80.

Pool cleaner 20 includes a shift bracket assembly 94 slidably held within a cavity 96 formed in body 24. Drive shaft 80 is journaled by a suitable bearing in shift bracket assembly 94. Shift bracket assembly 94 includes a roller 98 at its rear end for engagement by a cam wheel 100 that serves the purpose of controlling the fore-and-aft position of shift bracket assembly 94. A spring 102 is located within cavity 96 in a position between a fixed surface of body 24 and the front end of shift bracket assembly 94. Spring 102 biases shift bracket assembly 94 into engagement with cam wheel 100.

Since left drive shaft 80 is journaled in shift bracket assembly 94, the position of pinion gear 86*a* is determined by the fore-or-aft position of shift bracket assembly 94. In the forward position, pinion gear 86*a* engages primary wheelgear 32 of left front wheel 22*a*; in the rearward position, it engages secondary wheelgear 34 of left front wheel 22*a*. Left front wheel 22*a* moves in a forward direction when pinion gear 86*a* engages primary wheelgear 32; however, since the reverse side of pinion gear 86*a* is what engages secondary wheelgear 34 when pinion gear 86*a* is in the aft position, such engagement results in reverse rotation of left front wheel 22*a*. And, by virtue of the driving linkage between left front wheel 22*a* and left rear wheel 22*c*, the aft position of pinion gear 86*a* also reverses the rotational direction of left rear drive wheel 22*c*. In other words, the periodic movement of shift bracket assembly 94 moves left drive shaft 80 and its pinion gear 86*a* to the aft position, and this interrupts the synchronous rotation of the drive wheels and causes turning of pool cleaner 20.

A major portion of cam wheel 100 has a fixed radius sufficient to allows cam wheel 100 to hold shift bracket assembly 94 in a forward position. Cam wheel 100 also has one or more smaller portions of lesser radius which allow shift bracket assembly 94 to move to its aft position under the biasing force of spring 102.

Cam wheel 100 is rotatably supported on an extension 104 of rotor shaft 79 at a position spaced from rotor 48. Also rotatably supported on extension 104 are several gear members of a reduction gear assembly 106, the purpose of which is to reduce rotational speed such that cam wheel 100 turns slowly—at a rate such that its portions of greater or lesser radial dimension dwell in contact with roller 98 of shift bracket assembly 94 for reasonable periods of time. More specifically, the gearing and cam design are such that the pool cleaner 20 will move in a forward position most of the time, and only intermittently change directions for short periods of time.

Figure 8:
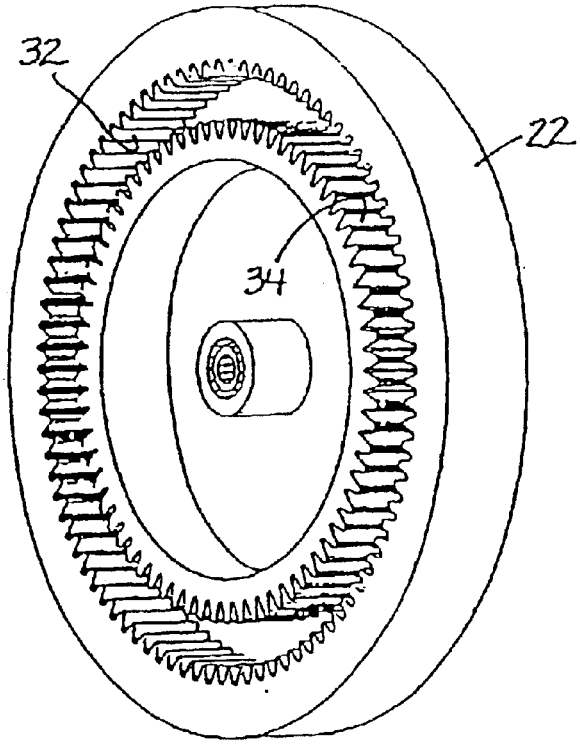
FIG. 8 is a perspective of one of the drive wheels, with its annular tread piece removed.

Primary and secondary wheelgears 32 and 34 are integrally formed with each of the drive wheels 22*a–d*. FIG. 8 illustrates the main portion of one such drive wheel, with its tread piece removed.

Figure 9:
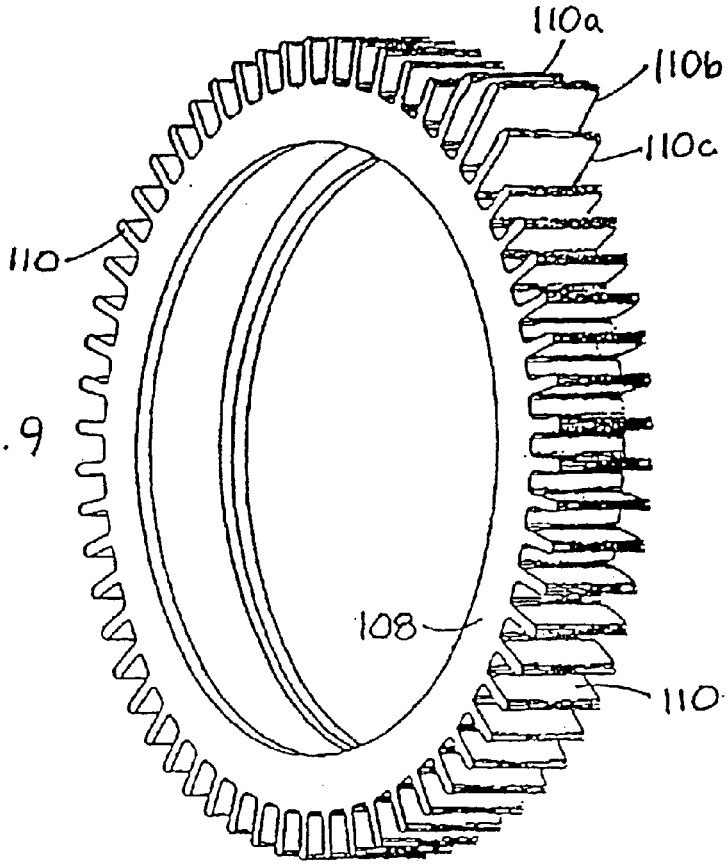
FIG. 9 is a perspective of the tread piece.

FIG. 9 illustrates a resilient elastomeric tread element 108 which is shaped for firm engagement about the periphery of the main portion of each drive wheel and to provide good traction. Tread element 108 has many outwardly extending resilient radial fingers 110. These tread features on the drive wheels of the present invention provide increased traction on slippery surfaces. This tread in combination with the large size of the drive wheels, which are essentially as large in diameter as the pool cleaner is high, allows the cleaner to ride over commonly encountered impediments and obstacles in the pool environment, including main drains, pool liner wrinkles, and uneven, convex and concave surfaces. Such drive wheels in the four-wheel-drive pool cleaner of this invention also allow the pool cleaner to navigate a vertical wall which joins a pool bottom surface without any curved transition (or "radius").

While elastomeric flexible treads are normally best, in certain applications, notably involving submerged tile surfaces, it may be preferable to fit the drive wheels with synthetic foam treads. When foam tread is used, effective grip and suction can be maintained on even the most slippery submerged inclined and vertical tile surfaces.

As shown in FIG. 9, three consecutive radial fingers 110*a–c* project radially farther than the others. As explained above, this serves to provide additional traction for dislodgement of the pool cleaner 20, if needed. Radial finger 110*b* extends slightly farther than radial fingers 110*a* and 110*c*.

Figure 10:
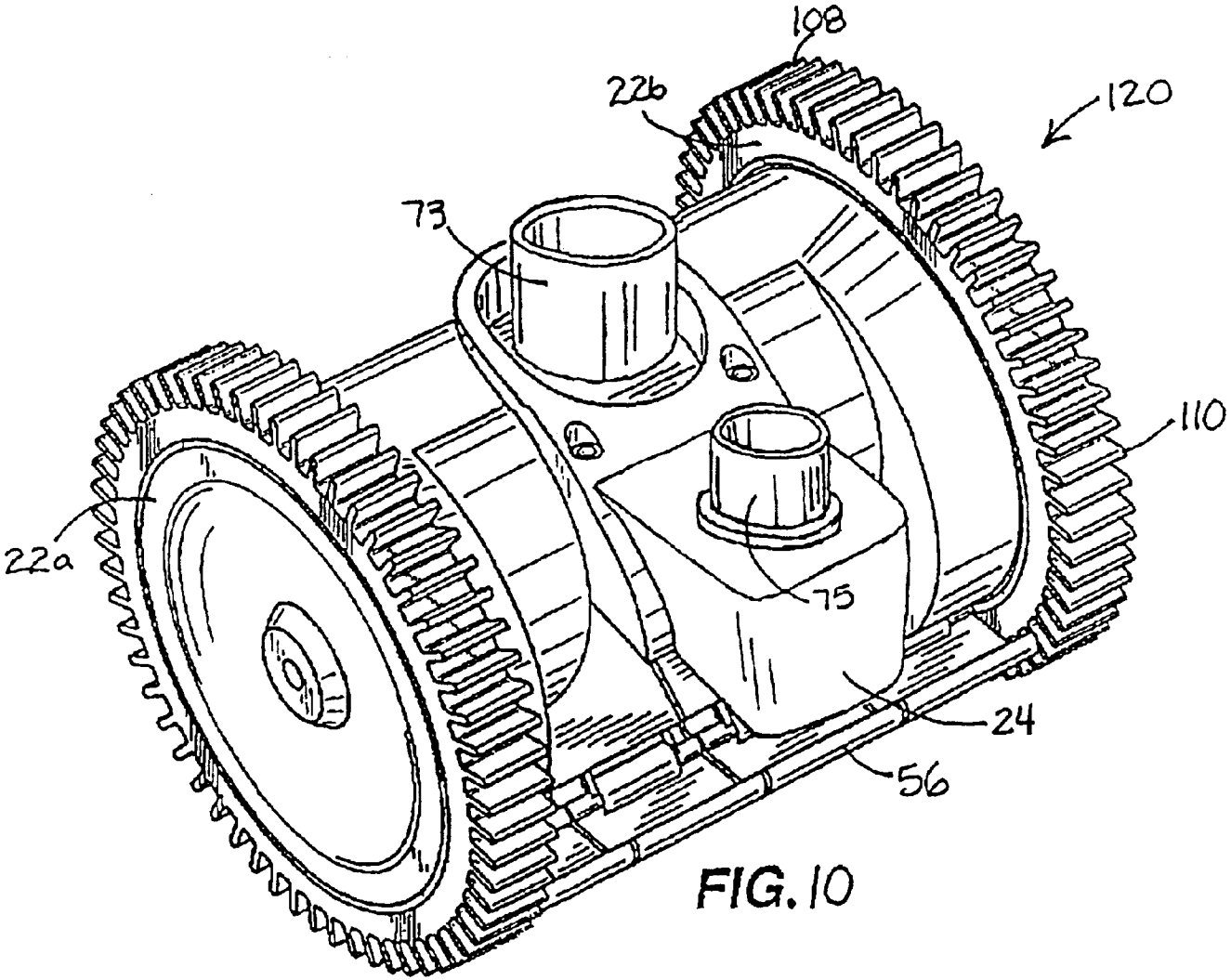
FIG. 10 is a perspective view of another preferred swimming pool pressure cleaner in accordance with this invention, a pool cleaner having only two wheels.

FIG. 10 shows a two-wheel swimming pool pressure cleaner 120 in accordance with this invention. Pool cleaner 120 is powered, supported and steered by two, rather than four, drive wheels. Pool cleaner 120 is similar to pool cleaner 120 in all significant respects, the principal differences being only that the rear wheels, the rear wheel mounts and the rear wheel drive linkages are absent.

Most of the parts of the pool cleaners of this invention may be formed using rigid plastic parts, as is well known in the art. Suitable materials for all of the parts would be apparent to those skilled in the art who are made familiar with this invention.

A number of variations are possible in design and construction of swimming pool pressure cleaners in accordance with this invention. The number of venturi jets can be varied, either up or down form the two referred to above. Having said that, however, it should be pointed out that the use of multiple venturi jets dramatically increases the pressure differential between the water in plenum 62 and the water in the region immediately above venturi jets 66*a* and 66*b*. This allows better pick-up of heavier particles of debris.

Likewise, variations in the flow of water between the hose and the venturi jets are possible. It is required, however, that the incoming flow of water serve the dual purposes of moving the turbine rotor and creating the necessary venturi effect to cause the drawing of water and debris into a filter, such as the bag illustrated.

While the principles of this invention have been described in connection with specific embodiments, it should be understood clearly that these descriptions are made only by way of example and are not intended to limit the scope of the invention.

We claim:

1. In a swimming pool pressure cleaner of the type including a body, wheels rotatably mounted to the body, a turbine housing having a water-flow chamber formed by a chamber wall and having an inlet and an outlet, a turbine rotor rotatably mounted in the chamber and having vanes, a drive member secured to the rotor and a drive train from the drive member to synchronously drive the wheels on underwater pool surfaces, a venturi jet and a water conduit to feed water to the venturi jet from a hose, the improvement comprising:

the turbine inlet being supported in close proximity to the pool surface;

the venturi jet located at the turbine inlet and oriented to direct water into the inlet to both rotate the turbine and cause water and debris to flow from the pool past the venturi jet and into the inlet; and a steering mechanism secured internally to the body and having a movable part to periodically interrupt the synchronous rotation of the wheels on the pool surface and thereby change the direction of the pool cleaner.

2. The device of claim 1 wherein the steering mechanism comprises:

a cam having portions of greater and lesser radii, the cam being rotatably secured to the body and driven by the rotor through reduction gearing; and a linkage from the cam to one of the wheels to periodically interrupt the synchronous rotation of the wheels on the pool surface.

3. The device of claim 1 including a plurality of venturi jets spaced from one another to facilitate passage of debris into the inlet.

4. The device of claim 3 wherein at least one of the venturi jets is oriented to provide an accelerated flow of water directly toward the outlet.

5. The device of claim 1 wherein the wheels have treads with a multiplicity of outwardly extending radial fingers.

6. The device of claim 5 wherein some of the radial fingers project radially farther than the other fingers, thereby to enhance traction for dislodgement purposes.

7. In a swimming pool pressure cleaner of the type motivated by water flow through it to move along a pool surface to be cleaned, the improvement comprising:

a body having a front, a rear and opposite sides;

a set of two wheels rotatably mounted to the body, one on each side;

a turbine housing secured to the body and having a water-flow chamber formed by a chamber wall, the chamber having an inlet and an outlet, the inlet being supported in close proximity to the pool surface;

a turbine rotor rotatably mounted in the chamber, the rotor having vanes;

at least one venturi jet secured to the body and oriented to direct water into the inlet to rotate the turbine and cause flow from the pool into the inlet;

water conduits to transmit water from a hose to the at least one venturi jet;

a drive member secured to the rotor and rotatable therewith;

a drive train from the drive member to the wheels for synchronous rotation thereof on the pool surface;

a cam having portions of greater and lesser radii, the cam being rotatably secured to the body and driven by the rotor through reduction gearing; and a linkage from the cam to one of the wheels to periodically interrupt the synchronous rotation of the wheels on the pool surface, thereby to change the direction of the pool cleaner.

8. The device of claim 7 including a plurality of venturi jets spaced from one another to facilitate flow of debris into the inlet, at least one of the venturi jets being oriented to provide an accelerated flow of water directly toward the outlet.

9. The device of claim 7 further including a debris-capturing bag secured to the outlet.

10. The device of claim 7 wherein the turbine vanes have proximal ends connected to the rotor and distal ends movable with respect thereto between extended positions adjacent to the wall and retracted positions spaced farther from the wall and closer to the rotor.

11. The device of claim 10 wherein the vanes are pivotably mounted with respect to the rotor.

12. The device of claim 11 wherein the vanes are curved and the distal edges of the vanes contact the chamber wall in their extended positions.

13. The device of claim 11 wherein the rotor has an exterior surface beneath which, for each vane, is a corresponding cavity which pivotably holds the proximal end of the vane.

14. The device of claim 13 wherein the vanes have enlargements at their proximal ends sized for free insertion into, and pivotable engagement in, the cavities.

15. The device of claim 7 wherein:

each of the wheels has an inward side and an outward side;

the first wheel of the set has radially-spaced primary and secondary wheelgears thereon facing one another on the inward side thereof;

the second wheel of the set has another primary wheelgear on the inward side thereof, the primary wheelgears being similar to one another; and the drive train portion terminates at the first and second wheels in first and second drive pinions, respectively, each engaging the primary wheelgear of the respective wheel;

thereby to drive the wheels synchronously in the forward direction.

16. The device of claim 15 wherein the wheelgears of the first wheel are integrally formed with the first wheel, and are concentric.

17. The device of claim 16 wherein the wheelgear of the second wheel is integrally formed with the second wheel.

18. The device of claim 17 wherein the first and second wheels are identical, whereby they are interchangeable.

19. The device of claim 15 wherein:

the drive member is a drive gear; and the drive train includes:

first and second drive shafts journaled with respect to the body and having proximal and distal ends;

the first and second drive pinions being driven by the first and second drive shafts, respectively; and a gear train from the drive gear to the first and second drive shafts.

20. The device of claim 19 wherein the first and second drive shafts form the first and second drive pinions, respectively, at the distal ends thereof.

21. The device of claim 20 wherein the drive train includes a coupler with opposite ends receiving the proximal ends of the first and second drive shafts.

22. The device of claim 21 wherein the proximal end of the first drive shaft is a ball joint allowing the distal end of the first drive shaft to be moved fore-and-aft between a driving position in which the first drive pinion engages the primary wheelgear of the first wheel and a steering position in which the first drive pinion engages the secondary wheelgear of the first wheel, thereby causing the first wheel to rotate in a direction opposite that of the second wheel, interrupting the synchronous rotation of the wheels on the pool surface.

23. The device of claim 22 wherein the linkage from the cam to the first wheel comprises:

a shift bracket assembly slidably held by the body, the first drive shaft being journaled therein for movement of its distal end between the driving and steering positions, the cam wheel engaging the shift bracket; and a spring biasing the shift bracket toward the cam wheel;

whereby the cam wheel, acting through the shift bracket assembly, provides the fore-and-aft movement by alternately (a) holding the distal end of the first drive shaft in the driving position and (b) allowing the distal end of the first drive shaft to move to the steering position.

24. The device of claim 23 wherein the wheels have treads with a multiplicity of outwardly extending radial fingers.

25. The device of claim 23 wherein some of the radial fingers project radially farther than the other fingers, thereby to enhance traction for dislodgement purposes.

26. The device of claim 23 further comprising:

a second set of wheels, one on each side, each of the wheels of the second set having an inward side and an outward side;

a final wheelgear on the outward side of each of the wheels of the second set;

an extended drive train for each of the wheels of the second set, each such extended drive train including:

a transfer shaft journaled with respect to the body;

a first transfer pinion engaged with one of the primary wheelgears; and a second transfer pinion engaged with one of the final wheelgears; thereby to provide rotation of the wheels of the second set.

27. The device of claim 26 wherein each transfer shaft forms the first and second transfer pinions at opposite ends thereof.

28. The device of claim 27 wherein:

the wheelgears of all of the wheels are integrally formed with the wheel; and all four of the wheels are identical, whereby they are interchangeable.

29. The device of claim 7 further comprising:

the inlet is facing the pool surface; and a skirt secured with respect to the body and extending toward the pool surface such that the skirt and the body, together with the pool surface, form a plenum from which water and debris are drawn into the inlet, the skirt including at least one flap member having upper and lower articulating portions, the upper articulating portion having a proximal edge hinged to the body and a lower edge hinged to the lower articulating portion.

30. The device of claim 29 wherein the skirt is segmented in that it comprises a plurality of the articulated flap members in side-by-side arrangement, thereby to facilitate relative enclosure of the plenum despite encountered irregularities in the pool surface immediately under the pool cleaner.

31. The device of claim 30 including a plurality of venturi jets spaced from one another to facilitate passage of debris into the inlet, at least one of the venturi jets being oriented to provide an accelerated flow of water directly toward the outlet.

* * * * *